US008764344B2

(12) United States Patent
Simoncelli et al.

(10) Patent No.: US 8,764,344 B2
(45) Date of Patent: Jul. 1, 2014

(54) METHOD FOR LAYING PIPES AND A MACHINE FOR ACTUATING THE METHOD

(75) Inventors: Aurelio Simoncelli, Pesaro (IT); Giuliano Ciaroni, Fano (IT)

(73) Assignee: Enereco S.p.A., Fano (PU) (IT)

( * ) Notice: Subject to any disclaimer, the term of this patent is extended or adjusted under 35 U.S.C. 154(b) by 145 days.

(21) Appl. No.: 13/496,878

(22) PCT Filed: Sep. 16, 2010

(86) PCT No.: PCT/IB2010/054177
§ 371 (c)(1),
(2), (4) Date: Mar. 17, 2012

(87) PCT Pub. No.: WO2011/033462
PCT Pub. Date: Mar. 24, 2011

(65) Prior Publication Data

US 2012/0177444 A1 Jul. 12, 2012

(30) Foreign Application Priority Data

Sep. 17, 2009 (IT) ..... BO2009A0593

(51) Int. Cl.
*F16L 1/028* (2006.01)

(52) U.S. Cl.
USPC ..... 405/184; 405/174; 405/184.1; 405/184.4; 254/29 R

(58) Field of Classification Search
USPC ..... 405/174, 184, 184.4, 184.1; 254/29; 269/55, 37; 29/281.1, 235
See application file for complete search history.

(56) References Cited

U.S. PATENT DOCUMENTS

| | | | | |
|---|---|---|---|---|
| 4,403,890 | A * | 9/1983 | Miyanagi et al. | 405/184 |
| 5,044,825 | A * | 9/1991 | Kaldenbach | 405/166 |
| 6,481,930 | B2 * | 11/2002 | Forrest | 405/184 |
| 2005/0117973 | A1 * | 6/2005 | Nelson | 405/184.5 |
| 2006/0193697 | A1 * | 8/2006 | Wentworth et al. | 405/184 |

FOREIGN PATENT DOCUMENTS

| | | | |
|---|---|---|---|
| EP | 1679462 | A | 7/2006 |
| EP | 2192259 | A | 6/2010 |
| NL | 2002143 | C | 4/2010 |
| WO | WO2009/055590 | * | 4/2009 |

OTHER PUBLICATIONS

International Search Report for PCT/IB2010/054177, Mailed Sep. 21, 2011, 3 pages.

* cited by examiner

*Primary Examiner* — John Kreck
*Assistant Examiner* — Carib Oquendo
(74) *Attorney, Agent, or Firm* — William J. Sapone; Ware Fressola Maguire & Barber LLP

(57) ABSTRACT

A method for laying a pipe includes predisposing first and second releasable gripping devices for firmly gripping or releasing the pipe. The gripping devices are located along the longitudinal direction of the pipe. The gripping devices when activated grip and move the pipe so that only a predetermined longitudinal pipe section is received in the laying site. The gripping devices are rearranged and activated, instant by instant, so that the pipe is at all times solidly gripped by at least one gripping device. The above step is repeated until multiple longitudinal sections are housed in the laying site. A machine for laying pipe has gripping devices independently activatable for firmly gripping or releasing the pipe and also for moving the first and/or second gripping devices a predetermined number of times while gripping the pipe, for moving multiple longitudinal pipe sections into the laying site.

12 Claims, 3 Drawing Sheets

METHOD FOR LAYING PIPES AND A MACHINE FOR ACTUATING THE METHOD

TECHNICAL FIELD

The present invention relates to laying pipes for oil pipelines, gas-pipelines, aqueducts and the like.

In particular, and not exclusively, the invention relates to laying pipelines in prefabricated tunnels.

BACKGROUND ART

When pipes for pipelines, gas-pipelines and similar grids formed by conduits have to cross geographical zones having irregular orography, or comprising rivers, inhabited areas, railway lines, motorways or other surface infrastructures, the conduits themselves have to pass beneath the ground.

To this end, special prefabricated tunnels are predisposed (in this context going by the name of microtunnels, abbreviated to MT), frequently defined by reinforced-concrete walls, each suitable for internally receiving a pipeline, and having an extension which is sufficient for complete crossing of the above-mentioned geographical zones by the pipeline.

In practice, the tunnel is provided with a mouth and an exit located at ground level, respectively for insertion and exit of the conduit previously or already realized in its entirety, or realized in a multiplicity of prefabricated sections which are then joined to form the whole pipeline.

At present, for laying or threading a pipe in the tunnel, a process as follows is used.

A head member provided with a hook is fixed to a first end of the pipe.

A cable is fastened to the hook, which cable must be of such a length as to be insertable in the mouth of the tunnel such as to pass through its total length up to emerging from the exit, then to be connected to a hoist.

The hoist is activated such that the cable draws the pipe into the tunnel up until it is completely threaded through it.

Experience has taught that this process is subject to a serious drawback, as follows.

The tunnel is usually constructed such as to describe a pathway that is substantially parabolic along the longitudinal development thereof, with an ideal vertex located below ground level.

In some not infrequent cases the tunnel also exhibits a drop in level between the entry and the exit.

In other words, a downstream part thereof can be arranged in descent with respect to an upstream part, and the tunnel can be said to be in descent.

In practice, the substantially parabolic pathway described above has an ideal vertex which is not the lowest point of the tunnel, but which is instead at a section of the tunnel downstream of the vertex, and at times in proximity of the exit.

In this case, during threading, at least a component of the velocity of the conduit is due to force of gravity, also in the sections of the tunnel that are close to the exit or which are in any case located downstream of the ideal vertex of the substantially parabolic pathway.

As the pipe is usually made of steel, and has significant dimensions, it is very heavy.

Owing to this, experience has shown that the in some cases the pipe can proceed internally of the tunnel even when the hoist is not performing traction, due to inertia and/or force of gravity.

This occurs not only in the sections close to the mouth, but also those downstream of the ideal vertex of the substantially parabolic pathway.

In these cases, its insertion in the tunnel is not controlled by the operators and the velocity the pipe proceeds at internally of the tunnel can consequently be unregulated by the operators.

The consequences of this eventuality can be very negative.

Indeed, not only is there the possibility that the conduit gets damaged during its uncontrolled sliding in the tunnel at an excessive velocity, there is especially the risk that the conduit will emerge from the tunnel at considerable speed, with the possible risk of damaging structures or machinery in the worksite that are predisposed downstream of the tunnel; not to mention the possible risk of injury to personnel.

TA further drawback of the known process is constituted by the fact that during use it is contemporaneously necessary both to perform the traction operation using the hoist located downstream of the tunnel close to the exit, and to control the insertion of the conduit, and possibly even to supply the various prefabricated sections if the conduit is not inserted as a whole part, upstream of the tunnel, in the environs of the mouth.

This implicates having to set up two different worksites, one upstream and one downstream of the tunnel, with a consequent waste of means and personnel, and with the difficulties required for coordinating operations which have to be synchronized but which are performed in different geographic localities.

SUMMARY OF INVENTION

The aim of the present invention is to obviate the cited drawbacks and more besides, by providing a method for laying a pipeline for oil pipelines, gas-pipelines, aqueducts and the like in a laying site, such as for example a prefabricated tunnel, and a machine for carrying out the method.

The method of the invention comprises following steps:

a. predisposing at least first and second gripping means activatable for firmly gripping the pipe such as to be solidly constrained therewith, or alternatively activatable independently in order to release the pipe;

b. arranging the pipe and the first and second gripping means such that they are at all times located at predetermined points along the longitudinal development direction of the pipe;

c. moving the first and/or the second gripping means when activated to grip the pipe, such that only a predetermined longitudinal section of the pipe is received in the laying site, the first and second gripping means being always arranged with respect to the pipe and activated instant by instant in such a way that the conduit is always solidly gripped by at least one of the first and second gripping means; and d. iterating the previous step. until a predetermined number of predetermined longitudinal sections of the pipe are received in the laying site.

The machine for actuating the method of the invention comprises:

at least first and second gripping means activatable for firmly gripping a pipe such as to be solidly constrained therewith, or alternatively being actionable independently in order to release the pipe; and organs for moving the first and/or second gripping means a predetermined number of times when activated for gripping the pipe, therefore being solidly constrained therewith, such that only a predetermined longitudinal section of the pipe 1 is moved and it is received in the laying site.

As in the method and machine of the invention the pipe is solidly constrained at all times to the first and/or the second gripping means (at least one of the first and second gripping means), it is clear that the movement thereof is determined by and is a function of the first or second means of the gripping means, which is moment by moment activated to solidly grip it.

Also, as the gripping means activated to grip the pipe are moved such that only a predetermined longitudinal section of the pipe is received in the laying site, the possibility that the pipe might move uncontrollably through the laying site (which can also be a prefabricated tunnel of known type, known as a microtunnel) due to for example the force of gravity, inertia or a combination of both etc. is completely avoided.

According to the present method, which can be actuated by the proposed machine, the pipe is received in the laying site only in a predetermined section thereof determined by the movement of the gripping means by which is it solidly gripped.

This is possible thanks to the fact that the invention makes available at least two distinct gripping means, here termed first and second.

In this way, at any moment during the present method, at least one of them (let us say the first gripping means) grips the pipe in such a way that it is solidly constrained can be moved only pursuant upon a movement of the gripping means by which it is gripped, whatever other actions or movements the other gripping means might be performing, which might not be gripping the pipe (for example, the second gripping means).

Thus the velocity of the pipe during the laying operations is determined, controlled and regulated exclusively by the movement of the first or second gripping means.

In detail it is not necessary that at each instant the first and second gripping means are gripping the pipe, but, advantageously, it is sufficient that at least one of the gripping means is activated thus, the being, for example, free, after having been moved to insert a predetermined section of the conduit into the laying site, to release the conduit and relocate it in the starting position preceding the movement, for example in order to perform a subsequent movement after a new activation in order to grip the pipe.

By the expression "only a predetermined longitudinal section of the pipe is received in the laying site", or similar expression, the two extreme movement situations are also meant to be taken into account: i.e. the movement for receiving the whole pipe in the laying site or a null movement run, i.e. a simple retaining of the pipe. In the latter case, the section of the pipe received in the laying site has a null extension.

Further, for the sake of clarity, we specify that by the expression "up to receiving a predetermined number of predetermined longitudinal sections of the pipe in the laying site", we mean that the method of the invention concludes with the receiving of a whole pipe, i.e. the pipe considered in its entirety, in the laying site, or a part thereof, for example in a case in which the pipe is formed by prefabricated parts of a given longitudinal extension, thus a pipe taken to mean a sub-unit of a whole pipeline.

A particular case of laying site is the prefabricated tunnel, of a type known as a microtunnel in the ambit of the technical section to which the invention relates.

In this case, as has already been clarified, not only does the use of the present invention entirely obviate the drawback afflicting the known process in the case of a descending tunnel, but it also completely obviates the other drawback due to the need to ready to distinct work-sites.

The method of the invention is actuable by a machine located at or near the mouth of the tunnel, so that advantageously only a single work-site upstream of the mouth is sufficient.

An expert in the field is able to evaluate how to arrange the pipe with respect to the tunnel in order to actuate the present method (and thus how to arrange the machine actuating the method with respect to the pipe and the tunnel).

Typically the machine can initially place the pipe in such a way that the longitudinal development thereof is substantially parallel to the development of the tunnel and with the end that will first be received (i.e. inserted) in the tunnel facing the mouth thereof.

The expert person in the field can easily establish, without inventive activity, the inclination the pipe must have with respect to the ground and the tunnel.

A person expert in the field will know how to decide, for example according to the pipe's length or other typical variables of the sector, if it is necessary to use the devices and accessory parts which are usually employed in laying pipes, such as for example carriages for supporting sections of the pipe which have not yet been inserted in the tunnel.

It is specified that in the present description wide use of the microtunnel example will be made, in reference to the work-site, though the present invention enables insertion of pipelines also in vertical wells or pipelines which are destined to function as connecting parts with underwater pipelines (sea lines) when approaching terra firma, and in general in other uses known in the sector.

BRIEF DESCRIPTION OF THE DRAWINGS

Specific embodiments of the invention, and advantageous technical-functional characteristics thereof correlated to the embodiments which are only partly derivable from the above description, will now be described, in accordance with what is set out in the claims and with the aid of the accompanying figures of the drawings, in which:

FIGS. 6, 7, 8 and FIG. 1 are schematic representations of steps of a second embodiment of the method of the invention;

BEST MODE FOR CARRYING OUT THE INVENTION

With reference to the accompanying figures of the drawings, 1 denotes a pipe for oil pipelines, gas pipelines and the like, and 10 denotes the machine for laying pipes 1 of the invention, while 2 and 3 denote first and second gripping means.

In FIGS. 1-8, the first gripping means are denoted by 2, while the second gripping means are denoted by 3, but it is important to remember that what was described herein above for one of the gripping means is equally true for the other gripping means, and vice versa: so the reciprocal arrangement illustrated in FIGS. 1-8 has only an illustrative aim.

Further, note that the first and second gripping means 2, 3 activated to lock onto the pipe 1 are represented in FIGS. 1-8 in a thick and continuous line, while the first and second gripping means 2, 3 when activated to release the pipe are represented in a broken line.

Figure 1:
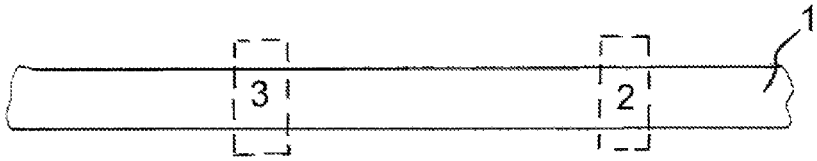
FIGS. 1, 2, 3, 4 and 5 are schematic representations of steps of a first embodiment of the method of the invention.

FIG. 1 represents step b of the method.

Figure 2:
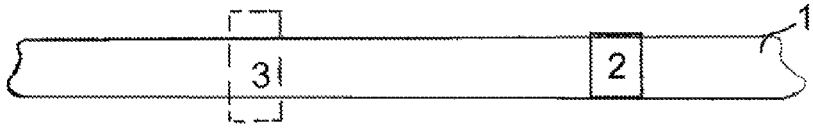
Figure 3:
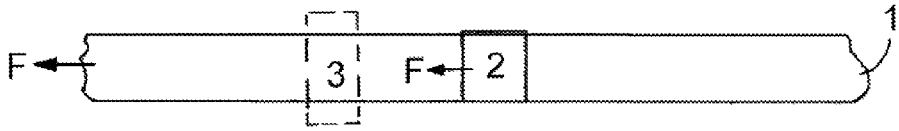
Figure 4:
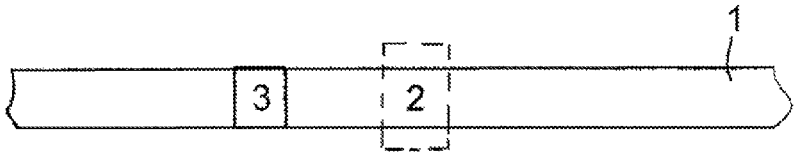
Figure 5:
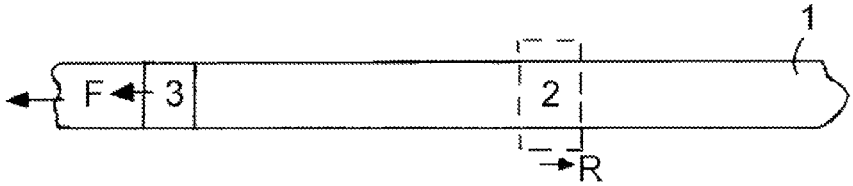

In a first embodiment, the method for laying a conduit 1 in a laying site (for example a microtunnel) comprises step c being carried by the following sub-steps (some of which are illustrated in FIGS. 1,2, 3, 4 and 5):

e. activating the first gripping means 2 such that the pipe 1 is firmly gripped by the first gripping means 2 such as to be solidly constrained therewith (see FIG. 2);

f. moving the first gripping means 2 in a first direction F such that only a predetermined longitudinal section of the pipe 1 is received in the laying site see FIG. 3);

g. activating the second gripping means 3 such that the pipe 1 is firmly gripped by the second gripping means 3 such as to be solidly constrained therewith (see FIG. 4);

h. activating the first gripping means 2 such that the pipe 1 is released thereby (see FIG. 4);

i. moving the second gripping means 3 in the first direction F such that only a predetermined longitudinal section of the pipe 1 is received in the laying site (FIG. 5);

j. moving the first gripping means 2 such that they perform a predetermined run in a second direction R opposite the first direction F (FIG. 5);

k. activating the first gripping means 2 such that the pipe 1 is firmly gripped thereby such as to be solidly constrained therewith;

l. activating the second gripping means such that the pipe 1 is released thereby;

m. moving the second gripping means (3) such that they perform a predetermined run in the second direction (R) opposite the first direction (F).

It is clear that the above-listed sub-steps are the minimum steps included in the present embodiment, but it is possible that the same embodiment might be performed with the addition of further sub-steps.

In other words, the list of sub-steps as reported above is not necessarily exhaustive.

It is clear that in a case of insertion of the pipe 1 in a prefabricated tunnel, and in which the pipe 1 is advantageously arranged such that the direction of its longitudinal development is substantially coincidental with the direction of the tunnel, the movement of the gripping means 2, 3 along the first and the second direction F, R will be in the same direction.

Thus the movement of the first and second gripping means 2, 3 in direction F will preferably be effected along the longitudinal development direction of the pipe 1.

In the same way, it is obvious that the movement of the gripping means 2, 3 happening in a same direction have extension runs such as to prevent an encounter between the gripping means 2, 3, which would happen if they were in the same absolute position.

The movements of the first and second gripping means 2,3 in both directions F, R preferably have the same run, though different runs are possible according to the specific laying needs of the pipe 1.

Further, during different movements of the first and second gripping means 2, 3 in direction F, a same force can be exerted on the pipe 1, or different forces each time.

Typically, during insertion of the last longitudinal sections of the pipe 1 into the tunnel before completing the insertion manoeuvre, it might be necessary to impress a greater force on the pipe 1 with respect to the force exerted with the preceding thrusts, for reasons connected to the friction, which will be more fully explained herein below.

In the above-described first embodiment, the following will preferably occur:

steps g and h are substantially simultaneous;

steps I and j are substantially simultaneous;

steps k and l are substantially simultaneous; and step m of an iteration is substantially simultaneous with step f of the following iteration.

In this way there is an advantageous laying of the conduit 1 (in particular: insertion in the MT) which is substantially continuous, and this too is made possible thanks to the advantageous detail of including at least two distinct gripping means 2, 3.

The two distinct gripping means 2, 3 are contemporaneously activated with one for gripping the pipe 1 and the other for releasing it, and then while one of the gripping means 2, 3 is retreated in direction R, the other of the gripping means 2, 3 is moved to insert the pipe 1 in the tunnel (more precisely to insert a predetermined section of the pipe).

This can be reiterated continuously during the laying (or threading) of the pipe.

More precisely, in the case of laying (or threading) the pipe 1 in a tunnel, it can be said that the proposed embodiment of the method enables a substantially continuous thrust of the pipe 1 into the tunnel.

In order to understand the notable advantage the above gives, it is worth specifying some aspects of laying pipes 1, which will be used herein with particular reference to MT threading, but which can be equally applied to other types of laying sites.

When the conduit 1 is thrust (as in the present method, or pulled, or in the known-type process) internally of the tunnel, it will necessarily always be in contact at least with the bottom of the tunnel (normally with an interposing of elements designed to function as protective bearings, as will be specified herein below, during the description of a particular aspect of the invention), or in any case with the internal surface of the walls made of reinforced concrete.

Thus its movement will be contrasted by the friction produced from this contact.

As is well known, since in these circumstances the static friction is often much greater than the dynamic friction, the use of the present invention, which produces and maintains a continuous thrust of the pipe 1 in the tunnel, advantageously enables much energy-saving (the friction the pipe will be subjected to will by mostly if not only of the dynamic type).

It is clear that during the final steps to be performed before completion of the threading operation, when the majority of the pipe 1 has already been inserted in the tunnel, the contact surface between the pipe 1 (or between the elements designed to function as a protective bearing) and the tunnel walls will be greater and therefore so will be the value of the friction.

In these circumstances, the movement of the first and second gripping means 2, 3 along direction F (i.e. for insertion into the tunnel) can be performed by exerting a greater force on the pipe 1 with respect to the force exerted in the first steps of laying.

Further, the laying of the pipe 1 with the method of the invention can be particularly rapid because useless pauses, or dead times, are avoided, for the same reasons as those for which the method enables a substantially continuous thrust of the pipe 1 in the tunnel.

If in FIGS. 1 to 8 the first gripping means 2 are represented retreated with respect to direction F in comparison to the second gripping means 3, this is only for illustrative purposes and what is described herein can also be applied with the first gripping means 2 located in an advanced position with respect to the second gripping means 3, relative to direction F.

Figure 6:
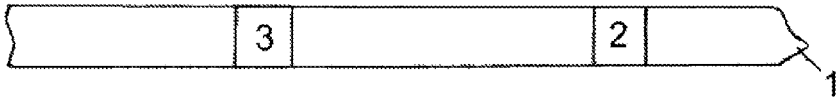
Figure 7:
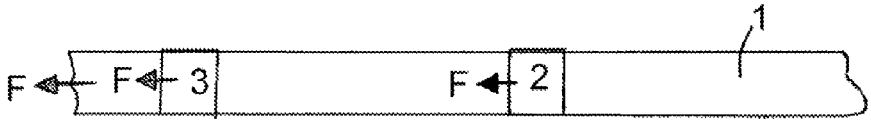
Figure 8:
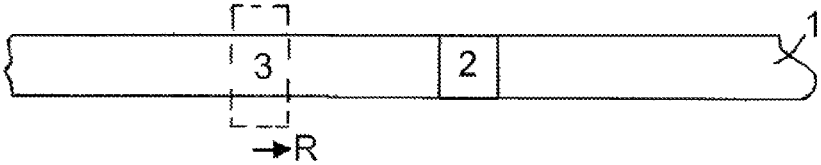

In an alternative embodiment, the pipe-laying method in a laying site comprises step c being carried out by the following sub-steps (some of which are represented in FIGS. 1, 6, 7 and 8);

p. activating the first and second gripping means such that the pipe is firmly gripped thereby such as to be solidly constrained therewith (see FIG. 6);

q. moving the first and second gripping means 2,3 in a first direction F such that only a predetermined longitudinal section of the pipe 1 is received in the laying site (FIG. 7);

r. activating the first gripping means 2 such that the pipe 1 is released thereby;

s. moving the first gripping means 2 such that they perform a predetermined run in a second direction R opposite the first direction F;

t. activating the first gripping means 2 such that the pipe 1 is firmly gripped thereby such as to be solidly constrained therewith;

u. activating the second gripping means 3 such that the pipe 1 is released thereby (FIG. 8);

v. moving the second gripping means 3 such that they perform a predetermined run in the second direction R (FIG. 8);

w. activating the second gripping means 3 such that the pipe 1 is firmly gripped thereby such as to be solidly constrained therewith (FIG. 6).

It is clear that in this embodiment too the listed sub-steps are the minimum but the present embodiment could be added-to by other sub-steps.

In other words the above-reported list of sub-steps does not necessarily have to be exhaustive.

The alternative embodiment can advantageously be used for the laying of pipes 1 which are especially heavy (for example due to considerable length, large diameter and high wall thickness).

In this embodiment, the first and second gripping means 2, 3 are contemporaneously moved in direction F, when locked on the pipe 1.

This means that in a case of laying in a tunnel, a thrust is exerted on the pipe 1 which is double that when using the first embodiment of the method, in identical conditions.

In the alternative embodiment too, in the realization of the method of the invention there is advantageously never a condition in which at least one of the first and second gripping means 2, 3 is not solidly gripping 1 the pipe 1 at any time during the whole laying operation.

Thus, even when using the method in the alternative embodiment, the velocity of the pipe 1 is established, controlled and regulated only by the movement of the gripping means 2, 3.

In order to understand a further advantageous aspect of the invention, there follows a description of a problem which might be encountered in laying a pipe 1 in a prefabricated tunnel.

As is well known to the expert in the field, the external surface of the wall of the pipe 1 is frequently clad in a sheath made of a plastic material, for passive cathodic protection.

Typically the sheath covers the surface substantially completely. As mentioned above, the tunnel is defined by walls made of reinforced concrete.

During the laying of the pipe 1, the pipe 1 has to slide in contact with the tunnel walls, and at least with the bottom thereof.

If this is done without special precautions, the sheath can be torn due to the friction with the concrete, and with a consequent compromising of the passive cathodic protection afforded.

To avoid this, a multiplicity of protection elements 9 are fixed to the pipe 1 (see FIG. 9, which represents a type thereof), externally thereof and conformed and arranged such as to cover the sheath.

In detail, the protection elements 9 are normally conformed as a ring or are toroidal, and they are typically arranged about the walls of the pipe 1.

Figure 9:
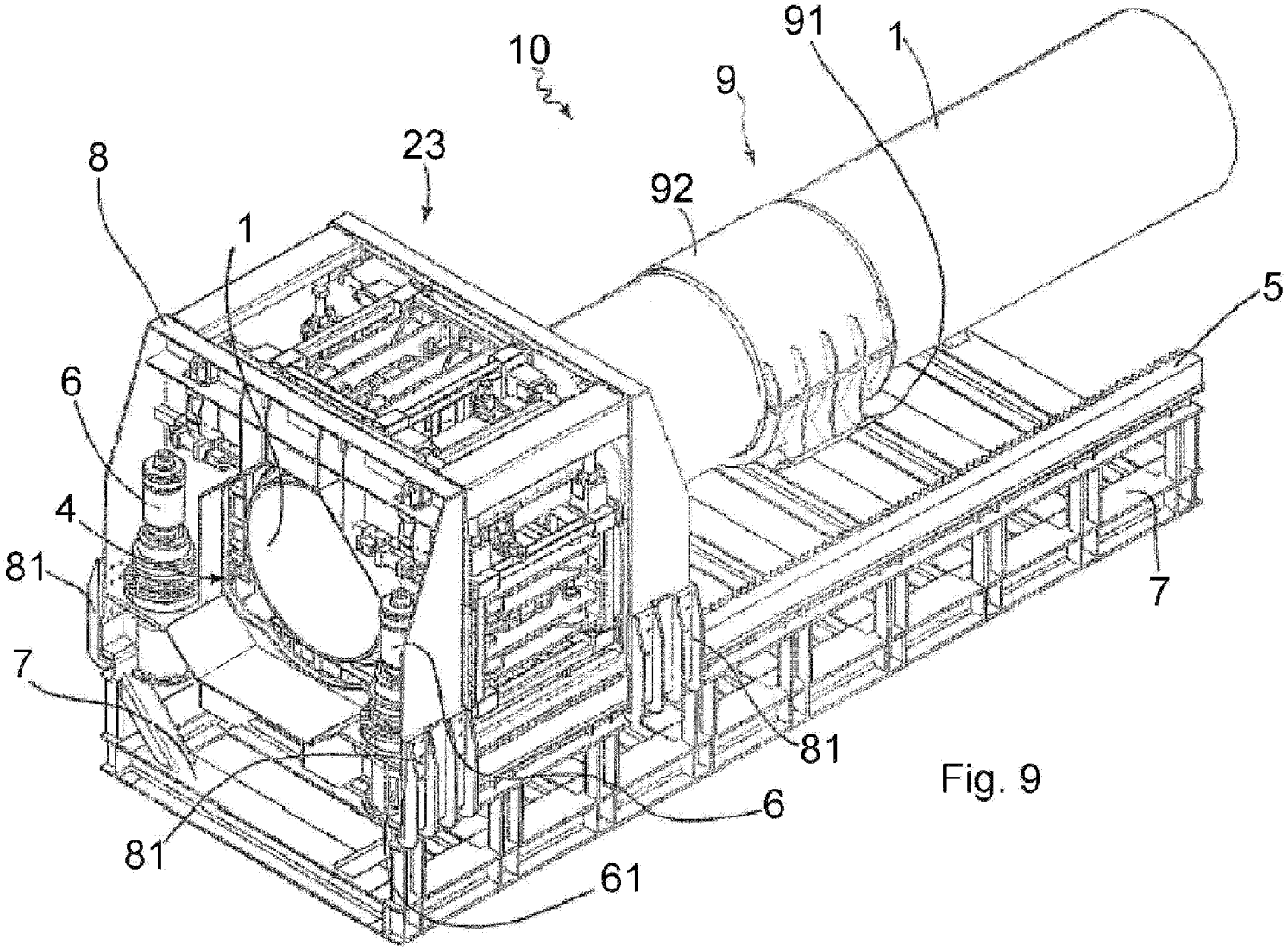
FIG. 9 is an axonometric view of a part of the machine associated to the pipe, in which only one of the first and second gripping means is illustrated.
Figure 10:
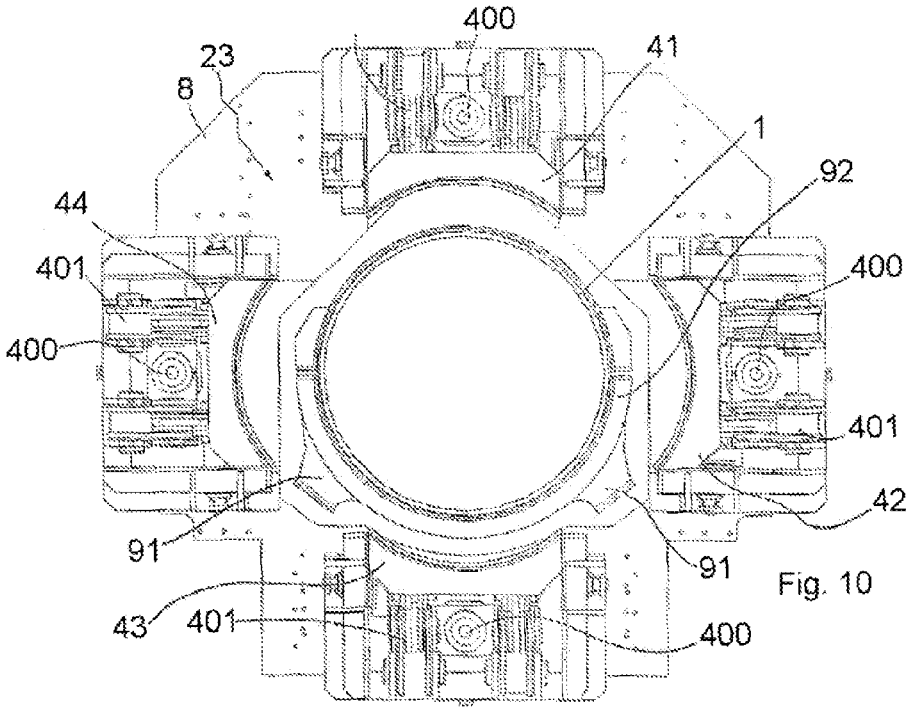
FIG. 10 is a vertical-section view of one of the first and second gripping means, once activated to release the pipe.
Figure 11:
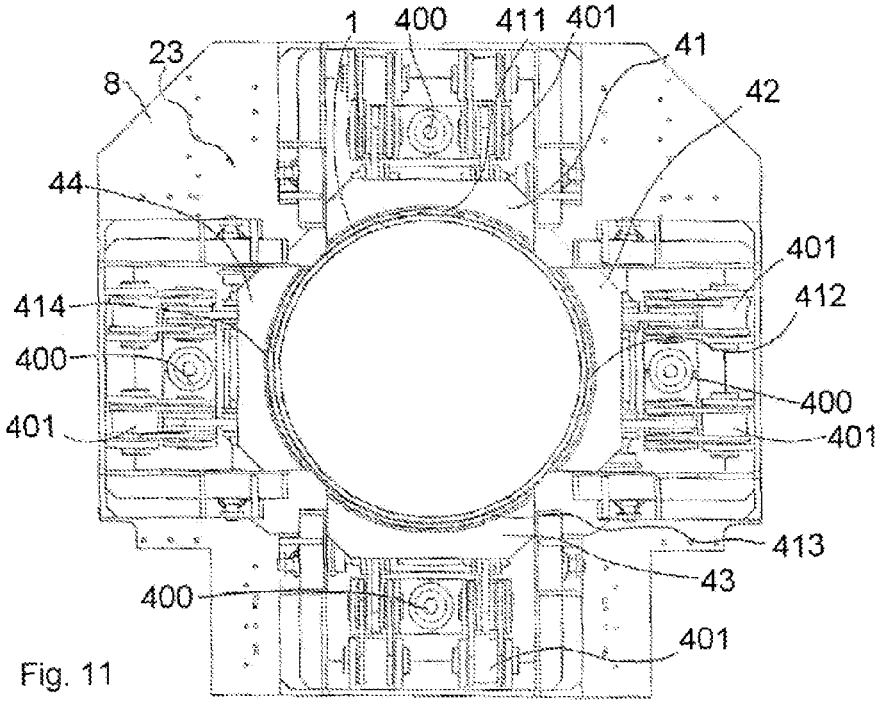
FIG. 11 is a vertical-section view of one of the first and second gripping means, made in a parallel plane to the plane of the preceding figure and when the first or second gripping means have been activated to grip the conduit.

A type of protection element frequently used, and for this reason illustrated in FIG. 9, comprises sliding skates 91 arranged in the periphery thereof, the skates being fixed to steel saddles which are the annular elements denoted by number 92 in FIGS. 9, 10 11, and which are tightened onto the pipe 1.

The skates 91 are a particular example of sliding means comprised in the periphery of the protection elements 9, though other elements having the same function are possible.

Each protection element 9 is positioned in predetermined points along the longitudinal development of the pipe 1, and at a predefined distance with respect to the others.

The aim of the use of protection elements 9 is to distance the sheath from the tunnel walls during laying of the pipe 1, and to function as a bearing therefore, such as to prevent damage thereto.

Each protection element can comprise walls of a predetermined thickness, substantially equal to the size of the spacing between the sheath and the tunnel walls (or more generally parts of the laying site with which the sheath would come into contact without the protection elements).

In detail, in the example of FIG. 9, i.e. in the case of saddles 92 with skates 91, the thickness of the protection element will be considered to be the thickness defined by the distance between the internal housing defined by the walls of the saddle 92 which houses the pipe and the external edges of the skates 91.

In any case, the thickness is in general determined by the distance between the internal housing edge of the pipe 1 and the external perimeter of the protection element.

Alternatively, and not infrequently, the protection elements are constituted by rings made of heat-hardening polyurethane resins.

In order for the protection elements 9 to perform their function, they must not be damaged, for example by the fact of being subjected to high pressures.

In order to completely prevent the first and second gripping means 2, 3 from damaging the protection elements 9 during the laying of the pipe 1, in an advantageous aspect of the invention the following occurs:

the first and second gripping means 2,3, when activated to release the pipe 1, are arranged at a distance from the external surface of the pipe 1 which is greater than the thickness of the walls of the protection elements 9, which depending on the predetermined points at which the protection elements 9 are positioned along the longitudinal development of the pipe 1, the positioning of the first and second gripping means 2,3 during step b. and the run of the movement of the first and second gripping means 2,3 in direction R are such that the first and second gripping means 2,3 are activatable for gripping the pipe 1 only at points of the longitudinal development thereof which are different from points in which the protection elements 9 are positioned.

In this way, the risk of damage to the protection elements 9 is completely prevented, and consequently the sheath too, during the laying of the pipe 1 in prefabricated tunnels made of reinforced concrete.

In a special embodiment of the machine 10 which actuates the method of the invention, the first and second gripping means 2, 3 are arranged, with respect to the pipe 1, such as to be located at predetermined points along the longitudinal development direction of the pipe 1, and further the organs 5, 6 for moving the first and/or the second gripping means 2, 3 are suitable for moving the means 2, 3 along a first direction F, in order to house the predetermined longitudinal section of the pipe 1 in the laying site, and for moving in a second direction R, opposite the first F, for a predetermined run.

The movement organs 5, 6 are preferably suitable for moving the first and second gripping means 2, 3 along the longitudinal development direction of the pipe 1 over predetermined runs.

By using the embodiment of the machine 10 described above, both the first and the second embodiments of the method of the invention can be advantageously actuated, providing the advantages as detailed herein above.

In particular, the following can be comprised:

the first and second gripping means 2,3, when activated to release the pipe 1, are arranged at a distance from the external surface of the pipe 1 which is greater than the thickness of the walls of the protection elements 9, and depending on the predetermined points at which the protection elements 9 are positioned along the longitudinal development of the pipe 1, the positioning of the first and second gripping means 2,3 and the run of the movement of the first and second gripping means 2,3 in direction R are such that the first and second gripping means 2,3 are activatable for gripping the pipe 1 only at points of the longitudinal development thereof which are different from points in which the protection elements 9 are positioned.

In this way, with the machine 10 of the invention, the above-described advantageous aspect of the method can be applied, which prevents damage to the protection elements 9.

From the practical point of view, each of the first and second gripping means 2, 3 can be constituted by a vice 4 comprising one or more gripping sectors (for example four), radially arrangeable with respect to the lateral sections of the pipe 1.

The vice 4 is actionable alternatively to close, locking solidly to the pipe 1, or to open in order to release the pipe 1.

FIGS. 10 and 11 illustrate the four gripping sectors 41, 42, 43, 44 comprised in a preferred embodiment of the vice 4, which can be arranged, for example, one above, one below, one on the right and one of the left of the pipe 1 (or respectively at 12 hundred, three hundred, six hundred and nine hundred hours).

Each gripping sector 41, 42, 43, 44 can comprise an internal surface 411, 412, 413, 414 conformed such as to abut with a portion of the external surface of the walls of the pipe 1, in order to lock the pipe 1 solidly via the respective gripping means 2, 3.

Each gripping sector 41, 42, 43, 44 can be conformed as an annular sector, more or less thick.

The internal surface 411, 412, 413, 414 of the gripping sectors 41, 42, 43, 44 can also be clad with a material suitable for functioning as an interposed cushion (for example an elastomer having a predetermined elasticity) in order to prevent even the remotest possibility of damage to the pipe 1 during the locking operation on the part of the first and/or the second gripping means 2, 3.

The activation of the first and second gripping means 2, 3 for locking or releasing the pipe 1 can be done by actuator means 400, 401, there being at least one for each gripping sector which is activatable to near or distance the gripping sectors of the vice 4 from the external surface of the walls of the pipe 1.

The gripping sectors 41, 42, 43, 44 are activatable by respective actuator means 400, 401 such as to near to the pipe 1 up to pressing it sufficiently to realize a solid locking, or alternatively such as to distance from the pipe 1, releasing it.

The actuator means are represented in FIGS. 10 and 11, in their preferred format by a jack 400 located horizontally and connected to the gripping sectors by means of a kinematic mechanism 401 for transmission of movement.

The movement of the first and second gripping means 2, 3 can be achieved thanks to the following components, well visible in FIG. 9, and comprised in the organs for moving the first and/or the second gripping means 2,3;

at least a rack 5, at least a motor 6 (preferably an oil-dynamic motor) connected to the first gripping means 2 such as to be solidly constrained thereto and at least a further motor 6 connected to the second gripping means 3 such as to be solidly constrained thereto;

at least a cogwheel 61 for each of the motors 6, each cogwheel 61 being connected to the respective motor 6 such as to be rotatable thereby, and arranged such as to enmesh with the rack 5.

In this case, the motors 6 are activatable independently to rotate the cogwheel 61 such as to translate the first and the second gripping means 2, 3 along the rack 5.

Typically more than one motor 6 is used for each of the gripping means 2, 3, preferably two motors 6 for each of the gripping means 2,3, as illustrated in FIG. 9.

The preferred embodiment of the machine 10 comprises a support frame 7, 8 in turn comprising:

a support base 7, anchorable to the ground, comprising a sliding rail, formed by two sliding lines, each of which comprises a rack 5 (in the case illustrated in the figures, each rail conforms a respective rack), a first and a second mobile structure 8 for respectively supporting the first gripping means 2 and the second gripping means 3, configured to slide restingly on the sliding lines, each of the first and the second structure 8 having fixed thereto the pair of motors 6, each motor 6 of the pair being connected to a respective cogwheel 61 which enmeshes a rack 5 different from the rack 5 enmeshed by the wheel 61 connected to the other motor 6 of the pair.

In this case, the activation of the pair of motors 6 fixed to each mobile structure 8 produces the displacement thereof along the rail (FIG. 9 shows only one of the sliding lines conforming its own rack).

For the purpose of a more precise control of the movement of the pipe 1 on the part of the first an second gripping means 2, 3 and also for reasons of constructional simplicity of the machine, both the first and the second gripping means 2, 3 are preferably suitable for supporting the pipe 1 when they are activated to lock solidly thereto.

This is possible because the first and the second gripping means 2, 3 are fixed to the respective mobile structure 8 which is connected to the support base 7, which thus unloads to the ground the weight of the pipe solidly locked thereby.

The support base 7 of the frame 7, 8 can be arranged such as to anchor on special platforms, for example made of reinforced concrete, which in turn are fixed to the ground.

A further possible aspect of the machine 10 of the invention relates to the use of anti-tilt guides denoted by 81 in FIG. 10.

When one or both of the first and second gripping means 2, 3 push the pipe 1 by means of the force generated by the motors 6 connected via the wheels 61 thereof to the rack 5, a reaction force is created on the part of the pipe 1 solidly coupled to the gripping means 2, 3.

This reaction force would tend to tilt the gripping means 2, 3, or rather the mobile structure 8 thereof, with respect to the fixed support base 7.

This is why each mobile structure can bear two anti-tilt guides 81, each located on opposite sides of the mobile structure 8 and conformed such as each to anchor to a relative sliding line, including a rack 5; for example the anti-tilt guides 81 can be hook-shaped.

All the steps of the method of the invention actuated by the machine 10 can be controlled by electronic processing units.

In particular, each activation and movement of the components making up the machine 10 of the invention can be regulated by computer processing programs.

The proposed method and machine 10 which actuates it can comprise more than two gripping means 2, 3.

In this way, the invention can for example perform the laying of the pipe 1 in an embodiment of the method which is a combination of what have been termed the first and the alternative embodiments herein described in detail.

The above has been described by way of non-limiting example, and any eventual constructional variations are understood to fall within the protective ambit of the present technical solution as claimed in the following claims.

The invention claimed is:

1. A method for laying a pipe in a laying site comprising the following steps:

a. providing at least first and second gripping means activatable for firmly gripping the pipe so as to be solidly constrained therewith, or for releasing the pipe;

b. locating the first and second gripping means with respect to the pipe at predetermined points along a longitudinal development direction of the pipe;

c. moving the first and/or the second gripping means when activated to grip the pipe, such that only a predetermined longitudinal section of the pipe is received in the laying site, the first and second gripping means being at all times arranged with respect to the pipe, and activated, instant by instant, in such a way that the pipe is at all times solidly gripped by at least one of the first and second gripping means; and d. iterating the above step until a predetermined number of predetermined longitudinal sections of the pipe are housed in the laying site; and, wherein an external surface of the pipe is covered by a sheath, and wherein a multiplicity of protection and support elements are fixed to the pipe externally thereto, each of the protection and support elements:

being conformed so as to cover the sheath by receiving said sheath between walls in an internal housing, and so as to have at a periphery thereof sliding means with an external environment;

having a predefined thickness between the internal housing and the periphery, and being fixed to the pipe at a predetermined point along the longitudinal development thereof and at a predefined distance from the other protection elements, and wherein the first and second gripping means, when activated to release the pipe, are arranged at a distance from the external surface of the pipe which is greater than the thickness of the walls of the protection elements, and in that depending on the predetermined points at which the protection elements are positioned along the longitudinal development of the pipe, the positioning of the first and second gripping means during said step b. and the run of the movement of the first and second gripping means in a direction are such that the first and second gripping means are activatable for gripping the pipe only at points of the longitudinal development thereof which are different from points in which the protection elements are positioned.

2. The method of claim 1, wherein the first gripping means and the second gripping means comprise at least one vice activatable to close, to solidly grip the pipe and to be solidly constrained thereto, or alternatively being active to open to release the pipe.

3. The method of claim 1 wherein step c is carried out by the following sub-steps:

e. activating the first gripping means such that the pipe is firmly gripped by the first gripping means so as to be solidly constrained therewith;

f. moving the first gripping means in a first direction such that only a predetermined longitudinal section of the pipe is received in the laying site;

g. activating the second gripping means such that the pipe is firmly gripped by the second gripping means so as to be solidly constrained therewith;

h. activating the first gripping means such that the pipe is released thereby;

i. moving the second gripping means in the first direction such that only a predetermined longitudinal section of the pipe is received in the laying site;

j. moving the first gripping means such that they perform a predetermined run in a second direction opposite the first direction;

k. activating the first gripping means such that the pipe is firmly gripped thereby so as to be solidly constrained therewith;

l. activating the second gripping means such that the pipe is released thereby;

m. moving the second gripping means to perform a predetermined run in the second direction opposite the first direction.

4. The method of claim 3 wherein:

steps g. and h. are substantially simultaneous;

steps i. and j. are substantially simultaneous;

steps k. and l. are substantially simultaneous; and step m. of an iteration is substantially simultaneous to step f of a following iteration.

5. The method of claim 1 wherein step c. is carried out by the following sub-steps:

p. activating the first and second gripping means such that the pipe is firmly gripped thereby so as to be solidly constrained therewith;

q. moving the first and second gripping means in a first direction such that only a predetermined longitudinal section of the pipe is received in the laying site;

r. activating the first gripping means such that the pipe is released thereby;

s. moving the first gripping means to perform predetermined run in a second direction opposite the first direction;

t. activating the first gripping means such that the pipe is firmly gripped thereby so as to be solidly constrained therewith;

u. activating the second gripping means such that the pipe is released thereby;

v. moving the second gripping means such that they perform a predetermined run in the second direction;

w. activating the second gripping means such that the pipe is firmly gripped thereby so as to be solidly constrained therewith.

6. A machine for laying a pipe in a laying site comprising:

at least first and second gripping means activatable for firmly gripping a pipe so as to be solidly constrained therewith, or for releasing the pipe, or alternatively being activatable independently in order to release the pipe; and organs for moving first and/or second gripping means for a predetermined number of times, when activated for gripping the pipe so being solidly constrained therewith, such that only a predetermined longitudinal section of the pipe is received in the laying site, such that the pipe (1) is housed in the laying site; and, wherein an external surface of the pipe is covered by a sheath, and wherein a multiplicity of protection and support elements is fixed to the pipe externally thereof, each of the protection and support elements:

adapted to cover the sheath by receiving said sheath between the walls in an internal housing, and so as to have, in a periphery thereof, contact means with the external environment, having a predetermined thickness between the internal housing and the periphery, and being fixed to the pipe at a predetermined point thereof along the longitudinal development thereof, and at a predetermined distance from the other protection elements, the first and second gripping means, when activated for releasing the pipe, being arranged at a distance from the external surface of the pipe which is greater than the thickness of the walls of the protection elements, and in that depending on the predetermined points at which the protection elements are positioned along the longitudinal development of the pipe, the positioning of the first and second gripping means and the run of the movement of the first and second gripping means in the direction are such that the first and second gripping means are activatable for gripping the pipe only at points of the longitudinal development thereof which are different from the points in which the protection elements are positioned.

7. The machine for laying a pipe of claim 6 wherein the first and the second gripping means each comprise at least one vice activatable for closing so as to solidly grip the pipe in such as way as to be solidly constrained thereto, or alternatively activatable to open so as to be able to release the pipe.

8. The machine for laying a pipe of claim 7 wherein the vice comprises: at least two gripping sectors arranged radially with respect to the pipe, at least one actuator means for each gripping sector, the gripping sectors being activatable by respective actuator means so as to move closer to the pipe, and for pressing against the pipe with a sufficient force to obtain a solid grip thereof, or alternatively so as to move a distance from the pipe in order to release the pipe.

9. The machine of claim 8, wherein the vice comprises four gripping sectors each conformed as an annular section.

10. The machine of claim 6 wherein the first gripping means and the second gripping means are arranged, with respect to the pipe, so as to be located at predetermined points along the development direction of the pipe and in that the organs for moving first and/or second gripping means are suitable for moving the first gripping means and the second gripping means along a first direction in order consequently to move the predetermined longitudinal section of the pipe so that the predetermined longitudinal pipe section is housed in the laying site, and for moving the first gripping means and the second gripping means in a second direction opposite the first direction for a predetermined run.

11. The machine of claim 6 wherein the organs for moving the first and/or the second gripping means comprise:

at least one rack, at least one motor connected to the first gripping means such as to be solidly constrained thereto and at least one further motor connected to the second gripping means so as to be solidly constrained thereto;

at least one cogwheel for each of the motors, each cogwheel being connected to the respective motor so as to be rotatable thereby, and arranged so as to enmesh with the rack, the motors being activatable independently to rotate the cogwheel so as to translate the first and the second gripping means along the rack.

12. The machine of claim 11 further comprising a support frame, which in turn comprises:

a support base, anchorable to the ground and having a sliding rail, formed by two sliding lines, each of which comprises a rack, a first and a second mobile structure for respectively supporting the first gripping means and the second gripping means, configured to slide restingly on the sliding lines, each of the first and the second structure having fixed thereto a pair of motors, each motor of the pair being connected to a respective cogwheel which enmeshes a rack different from the rack enmeshed by the wheel connected to the other motor of the pair, the activation of the pair of motors fixed to a mobile structure producing a displacement thereof along the rail.

* * * * *